US005315774A

United States Patent [19]

Chompff

[11] Patent Number: 5,315,774

[45] Date of Patent: May 31, 1994

[54] INFORMATION NOTATOR FOR WIRE, CABLE AND CABLE TIES

[76] Inventor: Conrad L. Chompff, 5524 Sepulveda Ct., Concord, Calif. 94521

[21] Appl. No.: 680,849

[22] Filed: Apr. 5, 1991

[51] Int. Cl.[5] ..... G09F 3/16

[52] U.S. Cl. ..... 40/316; 40/665

[58] Field of Search ..... 40/316, 6, 633, 301, 40/302, 665, 669; 24/453, 297, 573.1

[56] References Cited

U.S. PATENT DOCUMENTS 2,062,057 11/1934 Hobby ..... 24/453 X
4,198,772 4/1980 Furutu ..... 40/665
4,441,233 4/1984 Swift ..... 40/301 X

FOREIGN PATENT DOCUMENTS 330705 6/1930 United Kingdom ..... 40/665

*Primary Examiner*—Kenneth J. Dorner
*Assistant Examiner*—J. Bonifanti
*Attorney, Agent, or Firm*—Mark C. Jacobs

[57] ABSTRACT

A device adapted to be mounted, optionally removably, directly on wire and cable and indirectly thereon via cable ties and similar products, for the receipt of information or other indicia concerning the item to which the notator is attached or for the receipt of other information. The device includes a first indicia receiving portion and a second retainer portion for mounting the device on a substrate. An accessory engageable with one portion of the device or optionally built into that portion of the device includes a cable tie portion.

15 Claims, 4 Drawing Sheets

INFORMATION NOTATOR FOR WIRE, CABLE AND CABLE TIES

BACKGROUND OF THE INVENTION

As computer proliferate throughout home and industry, users find they are adding more and more peripherals such as printers, modems, scanners, etc. All of these utilize both electrical cords as well as signal cables. In a single user environment, one can usually fairly easily trace the wires to find the ends, in order to determine which is the first of perhaps several printers and which is the modem etc. But in a multiuser environment, where many cables from many terminals lead to a single shared printer switch box; or in a multiroom hi-fi setup it is next to impossible to determine which are the leads to the living-room speakers, and which go to the master bedroom. These are but a few of the plethora of instances, where wire and cable tracing is either not practical or is difficult to employ.

There is a need therefore for a means to notate specific wires and cables with information as to their location or function. Technicians may conceive of using a Sanford Sharpie TM or similar pen to write on the wire, such a trick is impossible at locations wherein a large number of small wires are employed, none of which is greater than a 1/16th of-an-inch in diameter, and which oftentimes are black in color.

There are of course other situations that arise in our daily lives wherein it would be helpful to have indicia notations pertaining to that article for the purpose of giving warnings, limitations on use; directions and other information. For example wiring of differing voltages, such as 110 Volt AC versus 12 Volt DC; power lines versus speaker "cables" among others.

It is an object therefore of this invention to provide several versions of a device having two primary portions, one of which is for the reception of data and the other of which is a mounting means.

It is another object to provide an information notator that is integrated into and forms a part of a cable tie or similar device and as such is indirectly mountable on cable or wire.

It is a yet further object to provide an indicia notator whose first portion can be made in various sizes and configurations.

It is a further object to provide an information notator capable of bearing indicia thereupon and adapted to receive substrates therein, i.e., direct mounting.

These and other objects of the invention will in part be obvious and will in part appear hereinafter.

The invention accordingly comprises the device possessing the features, properties and the relation of components which are exemplified in the following detailed disclosure and the scope of the application of which will be indicated in the claims.

For a fuller understanding of the nature and objects of the invention reference should be made to the following detailed description taken in conjunction with the accompanying drawings.

KNOWN PRIOR ART

As result of a search, the following U.S. patents are known to applicant:

| | | | |
|---|---|---|---|
| 0,224,958 | ROWLAND | 3,854,229 | MORGAN |
| 1,102,869 | KEAGY | 3,864,856 | MCMANUS |

-continued

| | | | |
|---|---|---|---|
| 1,427,891 | ZIEGLER | 4,198,772 | FURUTU |
| 1,558,406 | SNYDER | 4,226,036 | KRUG |
| 1,843,542 | DAWSON | 4,266,354 | DAENEN |
| 3,197,830 | HOADLEY | 4,268,986 | PIANA |
| 3,313,053 | VOGELI | 4,272,900 | MACLARTY |
| 3,372,500 | CLAUDE | 4,377,047 | ADAMS |

This and other objects of the invention will in part be obvious and will in part appear hereinafter.

The invention accordingly comprises the product possessing the features, properties and the relation of components which are exemplified in the following detailed disclosure and the scope of the application of which will be indicated in the claims.

For a fuller understanding of the nature and objects of the invention reference should be made to the following detailed description taken in conjunction with the accompanying drawings.

SUMMARY OF THE INVENTION

A notator adapted to be mounted via cable ties or other similar articles onto wire(s) and cable(s), and for direct mounting onto wires and cables for the receipt of information pertaining to the wire or cable itself or the wires or cable within the cable tie as the case may be. The device includes a first indicia receiving portion and a second retainer portion for mounting the device on a substrate. The second portion may be any of a separate unit; permanently affixed to the first portion or separable therefrom. An accessory for and engageable with the device includes a cable tie portion. The accessory can be built into the device itself and when built-in is designated as a second embodiment.

DESCRIPTION OF THE PREFERRED EMBODIMENT

Figure 1:
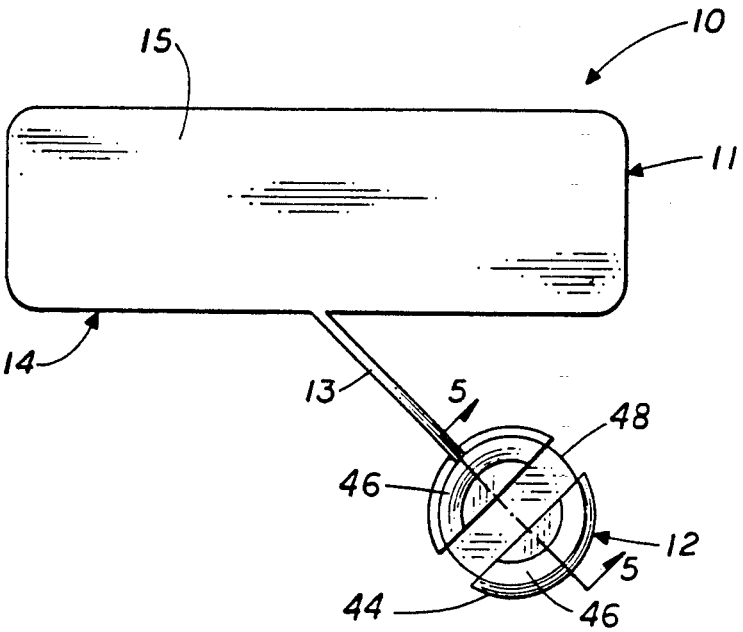
FIG. 1 is a top plan view of the first embodiment of this device.

In FIG. 1, there is seen a first embodiment of this device. Device 10 includes a first information receiving portion 11, and a second retainer portion 12 that matingly engages the first portion. Here, the retainer portion 12 is fixedly attached to the first or indicia receiving portion by a junction member, 13. However, in order not to clutter the figures, the junction member 13 is not shown in FIGS. 5 and 6, especially since it is deemed optional and if present can be readily removed and discarded if so desired.

Figure 5:
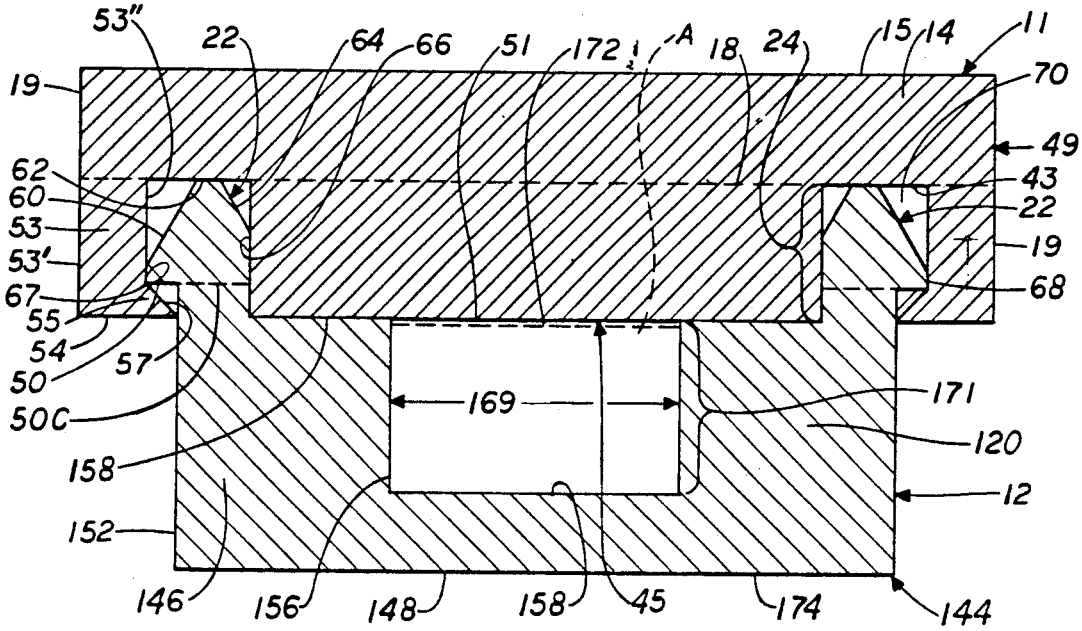
FIG. 5 is a sectional view of the device of FIG. 18 taken along line 5—5 and rotated 90 degrees clockwise.
Figure 6:
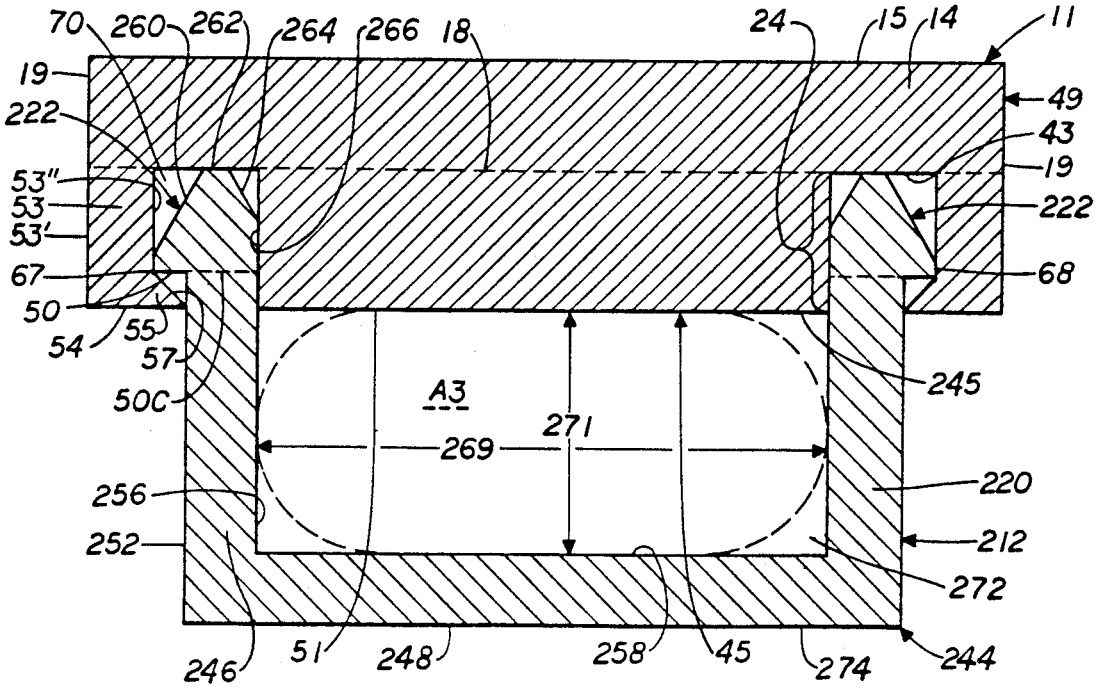
FIG. 6 is a sectional view of a variant of the embodiment shown in FIG. 5.
Figure 7:
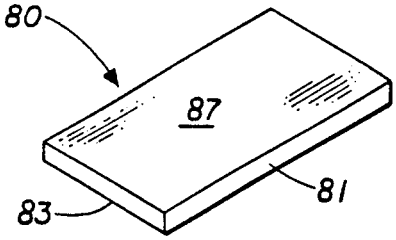
FIGS. 7, 8, 9, and 10 are top perspective views of several alternate configurations of one portion of this invention.

In the discussion to follow, details of the embodiment shown in FIG. 1 are set forth with respect to FIG. 5. The version of the device as shown in FIG. 6 is a variant of the device of FIG. 5 in that the retainer portion 12 is dimensioned differently to retain a larger cable within the confines of the device than is possible in the FIG. 5 device. Since the first portion 11 of the device is the same for both versions, the discussion about 11 will be pertinent to the device as shown in FIGS. 5 and 6. Those aspects of the retainer portion that are common to both versions will bear two digit numbers, while those aspects that differ will bear three digit number. The retainer as shown in FIG. 5 will bear numbers in the 100's while those of FIG. 6 will bear numbers in the 200's series.

Figure 2:
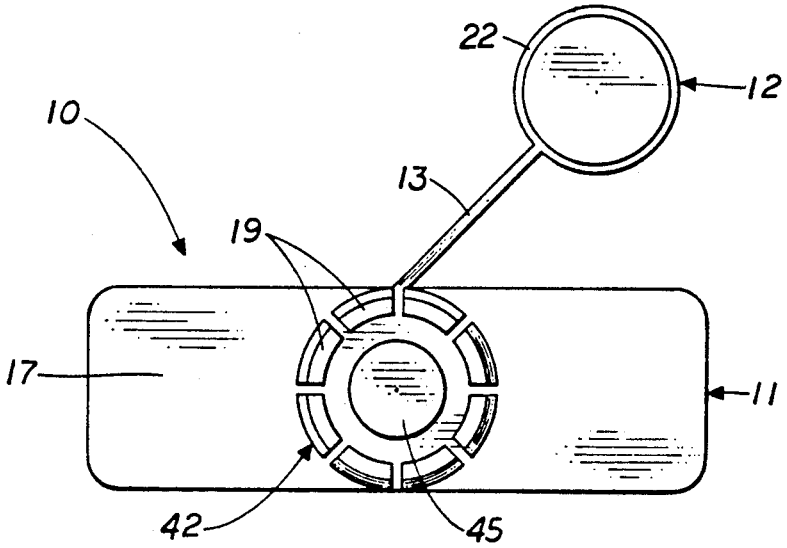
FIG. 2 is a bottom plan view of the first embodiment of this device.

FIG. 1 depicts device 10 in a top plan view, both of the first portion 11 and second portion 12. FIG. 2 is a bottom plan view of each of these aforementioned portions. Flexible junction member 13 is seen to be connected to the edge of each of these two portions.

The first portion 11, can range from about ½ inch to 1 inch in width and from about 1 inch to 4 inches in length. Any suitable material can be employed such as poly-propylene, polyethylene or a nylon. While pigment may be added, such as to differentiate different types of cables should that be desired, water white is quite acceptable as the color for both portions.

Reference should now be made to FIGS. 5 and 6. Device 10 includes a first portion 11 of preferably a generally rectangular configuration, wherein the upper surface, -also in FIG. 1—is designated 15 and the lower surface designated 17 which includes the engaging section 42 is seen in FIG. 2.

The second portion 12 of this device is seen to comprise a cup-like section having an upstanding side wall which side wall has dual aligned interruptions, and said section also includes a pentagonally configured detent ring at the upper edge of the side wall. As is readily seen the second portion 12 engages the first portion's engaging section 42, interiorly and this will be discussed below.

In FIG. 5 there is shown in a side sectional view, the device 10 in a matingly engaged operative condition. The device is comprised of a first portion 11 and a second portion 12, wherein the second portion 12, is removably secured interiorly to the downward depending encircling or circumscribing collar 49 of the first portion 11. Here the first portion 11 comprises a planar member 14, which has an upper surface 15 and a lower surface 17 (FIGS. 2). Centrally disposed on the lower surface 17, of the generally rectangular planar member 14, is the engaging section 42 comprising a circular disc member 45 of diameter lesser than the width of the planar member 14. Also see FIG. 6. The dashed line 18 represents the lower surface 17 of the planar member 14 and is the base from which disc 45 rises. In reality 45 is integrally formed with 14 during a molding process. The bottom surface of this circular member is designated 51. Spaced outward from the circular member, i.e., disc 45, is a circumscribing annular collar 49 disposed along the exterior edges of the width of the planar member 14, and spaced inwardly from the extremes along the length of the planar member. See FIG. 2. This collar 49 is comprised of a plurality of spaced arcuate segments 19, here shown to be 8 in number forming a circle. These segments are attached to lower surface 17 and are formed as a unitary structure with it during the molding process along with the planar member. See FIGS. 2 and 15.

Figure 18:
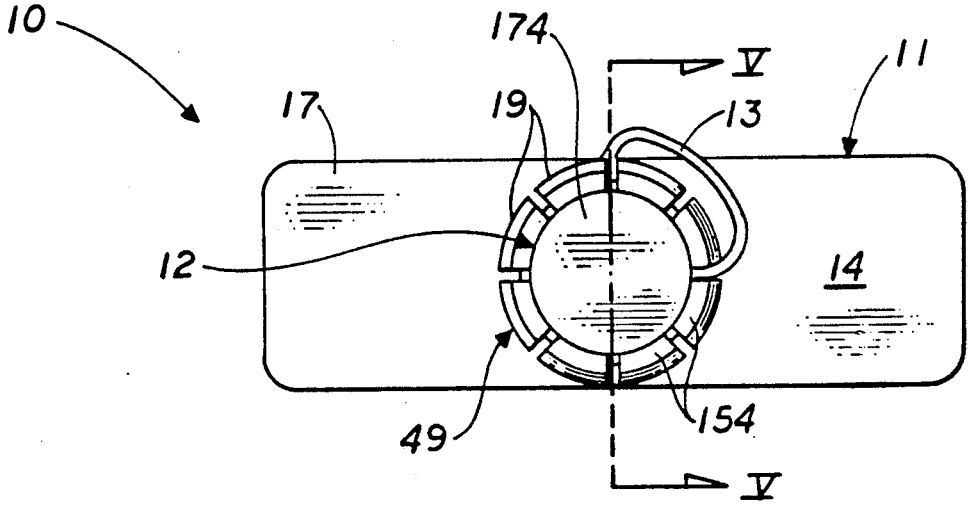
FIG. 18 is a bottom plan view of portion 12 engaged with portion 11, with junction member 13 still in place.

Each segment 19 has a first rectangular cross sectioned element 53, whose outer surface is designated 53' and whose inner surface is designated 53". The underside of this annular collar is designated 54. Collar 49's individual segments 19 also include a triangular boss 55 disposed upwardly from the interior edge of underside 54 along inner surface 53". The face or inwardly depending upwardly inclined surface of this boss 55 is designated 57. Reference is also made to FIG. 18.

The second or retainer portion 12, of this embodiment is composed of a plurality of sections attached to each other, but which in reality are all formed during the molding process as one unitary structure in the same manner as the segments 19 of collar 49 are integrally formed as a unitary structure with the planar member.

Retainer portion 12 is seen to comprise a cup-like section designated 144 in FIG. 5 and 244 in FIG. 6. Sections 144 and 244 each include a circular base 148, 248 respectively and a pair of spaced mirror image opposed vertical arcuate segments 120, 220 respectively upstanding from said base. Each of the two pairs of arcuate segments 120, 220 has a pentagonally configured detent 22 -to be discussed infra- disposed along its upper periphery along the line 50.

The outer surface of each arcuate segment is designated 152, 252; while the segments interior surface are designated 156 and 256. The underside of the bases 148, 248 are designated 174, 274 respectively and the bases interior surface are numbered 158, 258 respectively.

Each detent 22 -a two digit number being used as the designator since the detent is the same in both the FIG. 5 and the FIG. 6 versions of this embodiment- has a baseline formed along hidden line 50, which continues in the same plane beyond the outer edge of the cup-like sections along the line designated 50C for continuation (FIG. 6). The detent is further defined by the inwardly inclined surface which is designated 60 and which commences at the distal end of line 50C. Inwardly inclined surface 60 of detent 22 (FIG. 6) faces surface 53" of the first portion of this device, as seen in FIG. 5. Surface 60 terminates at top edge 62, which is disposed generally horizontally, i.e., parallel to base 148, 248. Top edge 62 terminates at the commencement of a downwardly and inwardly depending side edge 64, which in turn continues to the point of commencement of the fifth edge, a vertical side edge, 66. This side edge 66 terminates at the commencement point of baseline 50.

The interface of surfaces 53" and 57 is designated 67, while the interface of surfaces 60 and 50C is designated 68. The extension of line 50 and edge 50C is equal to or slightly less than the extension of lower surface 43. (Lower surface 43 corresponds to the space 70 between disc 45 and inner surface 53" of the downward extending segment 19.) A perpendicular line from the interior of line 50 to 62 would be parallel to and substantially equal to surface 53" and less than the height 24 of disc 45. The combined lateral extension of the sum of 50C and 50 is just slightly less than the extension of lower surface 43. Thus a snug fit of the pentagonal shaped detent 22 within the confines of space 70 can be had.

Figure 13:
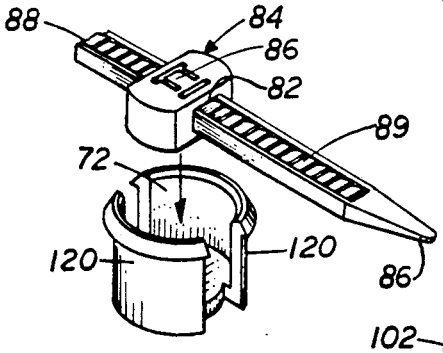
FIG. 13 is an exploded view showing how the accessory of FIG. 12 fits within a portion of the first embodiment of this invention.

Since the annular rectangular segments 53 of the collar 49 of the first portion are each somewhat flexible their bosses 55 can be flexed upwardly by the detents 22 of each of the arcuate segments such as 120 per FIG. 13 upon engagement of the retainer portion 12 with first portion 11. Thus a mating engagement of portion 2 to portion 1 can be had.

In addition, since triangular boss 55 is somewhat flexible, an outward tug of portion 12 would cause detent 22 to flex boss 55 on its outward travel to thereby permit disengagement.

The discussion now turns to the space to be occupied by a wire, cable or other substrate such as a cable tie during the engagement of portion 12 with portion 11. For the purpose of general discussion such space will be designated 72. However specifically with respect FIGS. 5 and 6 such space will be referred to 172 and 272. Thus in the discussion to follow for FIG. 4 among others, the general term 72 will be employed.

It can be seen from an inspection of FIG. 6 that the diameter of the item, such as a cable, to be carried in the space 272 between the two portions 11 and 12 and designated $A^3$ should be slightly smaller horizontally than the width 269 of the interior of cup-like section 244 and slightly shorter in its height than the height 271 which corresponds to the distance between the interior surface 58 and underside 51 of the first portion. Such statement is also true for item A which may be a cable tie which is seen in FIG. 5 to be disposed within the confines of the space 172 defined by the height 171 and the width 169. Thus it is to be understood that spaces 172 and 272 are in fact slots, or channels.

The discussion now turns to FIG. 6 wherein a variant of the second portion of the third embodiment is depicted as has been noted above. While the configuration of the second portion is generally the same as the second portion shown in FIG. 5, there are several dimensional differences. Reference therefore in the discussion to follow will only be made to those elements of the second portion not previously discussed which are different from those f the second portion of FIG. 5.

The dimensions of width 269 and height 271 are seen to be larger than their counterparts shown in FIG. 5. Each of the two arcuate segments 246 defines a lesser angle in the FIG. 6 version than in the FIG. 5 version where segments 146 are found. And, the thickness of the base 148 may be, but need not be, greater height (higher elevation) than is its counterpart 248 in the embodiment of FIG. 6.

However since the engagement means, detent 22, of the embodiment of FIG. 5 and the variant of FIG. 6 are the same, further discussion on the variant need not be set out.

The discussion now turns to FIGS. 7 through 10 inclusive. All of these figures pertain to various configurations of a part of the first portion; namely, the information receiver which in these figures have been numbered as 80, 90, 100, and 110. The present discussion is relegated to the upper surface of each of said indicia receivers. The indicia receiver 80 is the same as the planar member 14 discussed supra, since it too is a mere planar member 81, having an upper surface 87 and a lower surface 83. On such an indicia receiver, one could adhere a written notation upon surface 87 or write directly upon surface 87 as with a Sanford brand Sharpie pen which is a permanent marker that writes on most surfaces.

Figure 8:
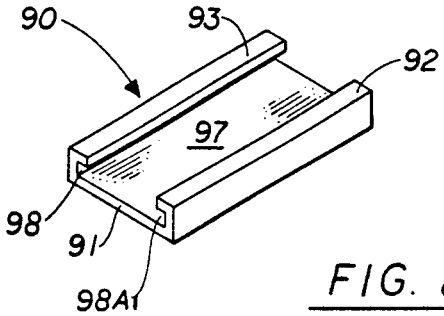

Indicia receiver 90 of FIG. 8 comprises a preferably rectangular planar member 91 having a pair of spaced opposed mirror image inverted L-shaped members 92 and 93 which act as message retainers, and which run along two parallel edges of the planar member, -here shown running along the longer direction of upper surface 97. Here the message can be written as noted above, or a printed indicia can be placed for frictional engagement within the grooves 98, 98A of the message retainers 92, 93.

Figure 9:
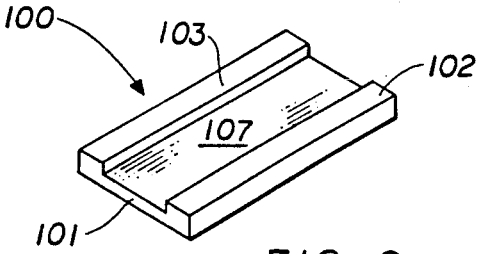

In FIG. 9, indicia receiver 100 includes a planar member 101, which has upstanding spaced bar(s) running along the outer edge. The term bar(s) is used to include a contemplated circular indicia receiver which would have only one outer edge and be adapted to receive a round dot piece of information such as a number of a few digits. The information can be penned in or placed on cardstock and frictionally fit between the here two upstanding bars as may be desired.

Figure 10:
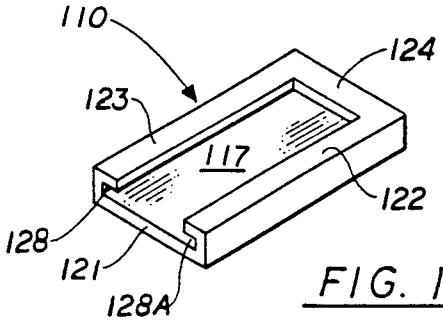

The receiver of FIG. 10 is similar to the one of FIG. 8, but with a third side closed off by a similar inverted L-shaped member 124 interposed between the members 122, and 123. It is believed that a piece of cardstock with information thereupon can be placed in a friction fit between grooves 128 and 128A or inserted with an adhesive onto surface 117.

Figure 17:
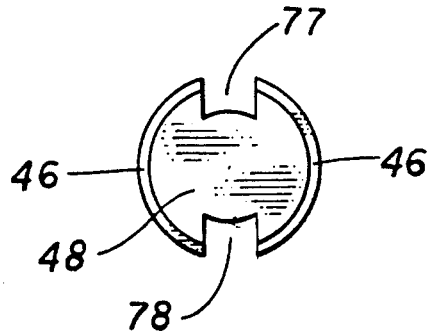
FIG. 17 is a bottom plan view of a variant of the second portion of this device.

In FIG. 17, a variant of the second portion is shown. A notch 77, 78 may be cut in each end of the base 48 between each of the spaced segments 46. See also FIG. 15. The formation of the notches at both ends of the base permits attachment of the device to smaller diameter cables, than if the notches are not present.

Figure 4:
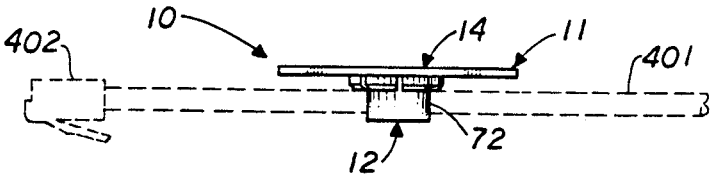
FIG. 4 is an elevational view showing the device of FIG. 1 deployed upon a six wire modular phone plug terminated cable.

While FIGS. 5, 6 and 4 show portion 12 in engagement, FIG. 18 is presented to show from a bottom plan viewpoint the engagement of the two portions. Note the presence of element 13. The element, which is optional only, is formed during the unitary molding of portions 11 and 12. Its purpose is to keep portion 12 from getting lost, i.e., keep it handy when 12 is to be engaged to 11. Since element 13 is flexible, even with 13 attached to 11 and 12 it is possible to rotate portion 11 after engagement with portion 12, relevant to portion 12 to reposition the planar member, parallel to or transverse to the wire or cable, or therebetween. Suitable hand bending at the two joints with portions 11 and 12 will permit the discard of element 13. Designator 174 refers to the flat circular area or underside of portion 12 in accordance with FIG. 5.

USAGE OF NOTATOR

The discussion so far has centered on the embodiment shown in FIGS. 1, 2, 5 and 15 and the variant of FIG. 6. The reader's attention is now directed to FIG. 3.

Figure 3:
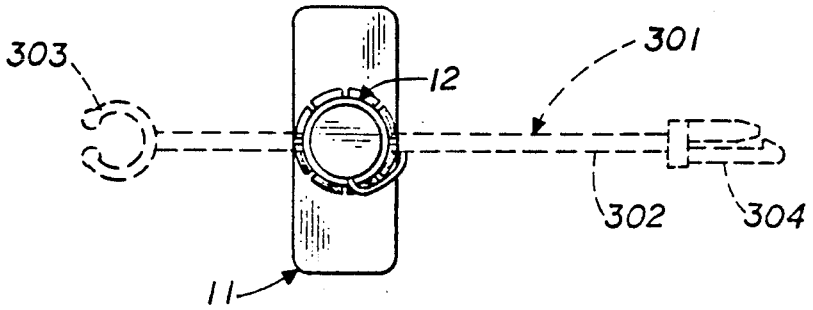
FIG. 3 is a bottom plan view showing the device of FIG. 1 mounted on a local area network transceiver cable lock, an article related to the cable tie.

FIG. 3 is a bottom plan view showing the device of FIGS. 1 and 2 having an Ethernet cable lock 301, disposed in space 72 between portions 11 and 12. Such cable lock 301 which resembles a cable tie in its body portion 302 is seen to have a cable mounting arcuate portion 303 and a third portion 304 which fits into a Ethernet local area network connector to prevent disconnection. This cable lock is the subject matter of my U.S. Pat. No. 4,919,619, with other patents pending.

Figure 11:
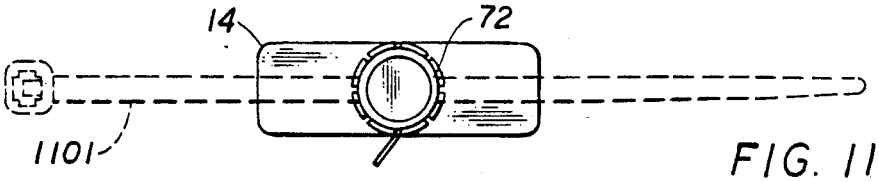
FIG. 11 is a bottom plan view of the device of FIG. 1 with the notation portion affixed at a 90 degree rotation from the mounting as in FIG. 3 and with a standard cable tie inserted.
Figure 12:
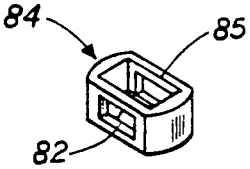
FIG. 12 is a perspective view illustrating an accessory for use with this invention.

FIG. 11 is also a bottom plan view of the device of FIGS. 1 and 2. Here however, the substrate disposed in space 72 is a common cable tie readily available from several manufacturers such as Panduit and Radio Shack among others. It is important to point out that the spatial orientation of planar member 14 is axial, along the length of the cable tie, whereas in FIG. 3 it was transverse to the length of the cable tie. That is because of the fact that the portion 12 being of a circular configuration can be engaged to portion 11 at any angle in which the space 70 may be oriented by the user.

Next reference is made to FIG. 4 which is a perspective view of the device of FIG. 1 shown mounted on a flat cable terminated with a 6 contact modular plug. Such six wire cables 401, having 6 contact modular plugs 402 are commonly used in large commercial telephone installations such as office buildings, airports, and department stores. Here, cable 401 is seen to be disposed in space 72 between portions 11 and 12. The planar member 14 of portion 11 is readily available to receive information thereupon.

Figure 16:
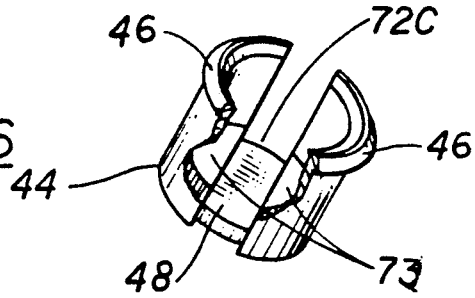
FIG. 16 is a close-up top perspective view of a preferred variant of a portion of this invention.

Reference should now be made to FIG. 16. Here portion 12's cup-like section 44 is seen to include a pair of mirror image spaced arcuate segments 46 disposed on base 48. Here in this particular version, a pair of spaced hemispherical platforms 73 of an elevation higher than that of base 48 but lower than that of the two arcuate segments are seen to be disposed within the interior curvature of each arcuate segment. These serve as a guide means for a cable tie in that the channel 72C, i.e., the recessed area of the space 72 which lies between the two platforms is sized specifically to receive and hold a cable tie and thus avoid lateral movement of said tie. These platforms are not disclosed in FIGS. 5 and 6 but are seen in FIG. 1.

ACCESSORY

The reader is now referred to FIGS. 12, 13, 14 and 15. All along this application has talked of engaging portion 12 to portion 11 with a cable tie, or a wire or a cable in space 72. If one desires to use a cable tie, it is seen that there lies the possibility of movement of device 10 along the cable after engagement of the two portions 11, 12. When wires or cable are disposed in a vertical orientation, this could prove to be a disadvantage.

It has now been found that the tie lock accessory for the device of this invention overcomes that problem. The tie lock 84 seen in FIG. 12 includes a body portion 85 configured as a chamfered corner rectangular solid, resembling a sardine can, with a horizontal latching slot 82 adapted to receive a cable tie, 88. It is known in the art how to provide a profile for stop elements 89 such that movement of the cable tie 88, which has such elements built in, in a first direction, per FIG. 13, allows the stop elements to pass through the slot 82 until the desired locus for disposition of accessory 84 upon the cable tie is achieved. When on the other hand, one attempts to withdraw the cable tie 88, the stop element in position binds upon a pivotal cam or tongue within the slot to prevent rearward disengagement of the tie. Such a mechanism is disclosed in the aforementioned Adams U.S. Pat. No. 4,377,047 among others. Here the tie lock 84, includes a pivotably mounted tongue 86, that is pivotable into said slot and is capable of engaging the angled stops 89 when the tie 88 is moved through the slot 82. When attempts are made to move the tie 88 in the opposite direction, the stop elements instead of camming the pivotal tongue out of the way, impact the tip of it and thereby prevent movement of the tie 88 through the slot 82.

Tie lock 84 is sized to fit within the confines of space 72 per FIG. 13, where it nestles between the opposed vertical segments 120. Tie lock 84 may have dimensions of about ⅛th inch in height, a length of about 5/16ths inch and a width of about 3/16th inch. Thus assuming the orientation of the cable tie within the tie lock for disposition within device 10 is such that tightening is upward, movement downward by gravity would be prevented. Thus device 10 would be fixed in place relative to the cable tie.

Figure 14:
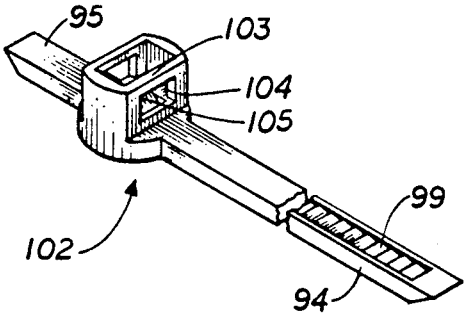
FIG. 14 is a perspective view of a variant of the accessory of FIG. 12.

Reference is now made to FIG. 14. Whereas in the just previous discussion, one utilizes a separate cable tie with the tie lock, 84, here in this figure the tie lock is designated 102 because it includes a built-in cable tie. Thus body portion 103 includes a receiving slot 104 into which the pivotally mounted tongue 105 communicates. See FIG. 15.

Figure 15:
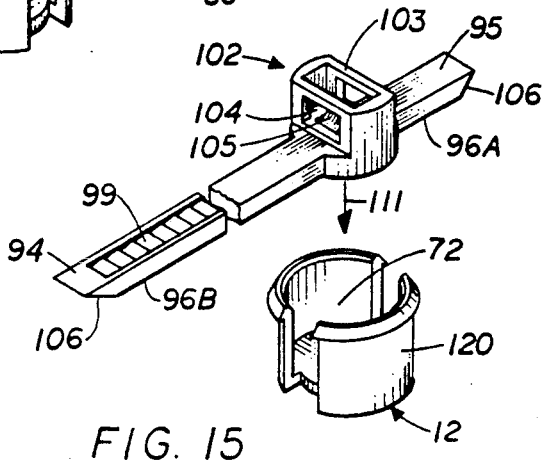
FIG. 15 is an exploded view showing how the variant of the accessory shown in FIG. 14 fits into a portion of the invention.

In FIGS. 14 and 15 the tie lock 102 is seen to include both an elongated strap 94 and a strappette 95. Both of these extend outwardly in opposite directions from body portion 103 along its lower edge. Both the strap and strappette have a rearwardly tapered forward edge 106. The taper depends toward the smooth undersurface 96B of said strap 94 and 96A of said strappette 95. The stop elements discussed previously are designated 99 and are seen in FIG. 15.

Also seen in FIG. 15 is a section of portion 12. The directional arrow 111 indicates how tie lock 102's body portion 103 fits down and into the space 72 of said portion. Reference is also made to FIG. 13 which shows tie lock 84 disposed as just mentioned.

It is within the skill of the art to have tie lock 84 formed as an integral part of portion 12 during a plastic molding procedure. It is also within the skill of the art to have the tie lock 102 with the built-in strap and strappette (the latter serving as a handle, or as a cable tie in tight spaces) integrally formed with portion 12 of the main device of this invention. See FIG. 15.

It is seen that I have provided a novel means of identifying cables, and wires and other objects which are capable of being secured to by a cable tie or similar article, e.g. my aforementioned L.A.N. connector lock. The devices of this invention may be provided in various materials, and in various colors which themselves can be used as an identifier such as of voltage, room in a building etc., even without printed notes being placed on or within the planar member.

It is to be understood, that if the content of a cable is rerouted, or changes made to all or parts of wiring, that the device of this invention can be removed by urging the two portions apart. One can accomplish this by use of the finger nail, or optional screwdriver or other pressure applying device.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A notator device for the receipt of information concerning the item or substrate, to which the notator device is attached, which device is both adapted to be mounted directly on wire and cable and indirectly on wire and cable via a cable tie;

said device comprises a first indicia receiving portion comprising a planar member having an upper surface and a lower surface, the upper surface being smooth for the receipt of information and having an engaging section on the lower surface directly beneath the surface for the receipt of information; and a second retainer portion matingly engageable with the engaging section for mounting the device on a substrate wherein the engaging section comprises (a) a circular disc of a diameter lesser than the width of the planar member (b) a circumscribing annular collar spaced outward from the circular disc disposed along the exterior edges of the width of the planar member, and spaced inwardly from the extremes along the length of the planar member.

2. In the device of claim 1 wherein the circumscribing annular collar comprises a plurality of spaced arcuate segments.

3. In the device of claim 2 wherein each spaced arcuate element has a first rectangular cross sectioned element and a triangular shaped boss disposed upwardly from the interior edge of the rectangular element.

4. In the device of claim 1 wherein the retainer portion comprises a cup-like section having a circular base and a pair of spaced mirror image opposed vertical arcuate segments upstanding from said base.

5. In the device of claim 4 wherein each of the two arcuate segments of the retainer portion includes a detent.

6. In the device of claim 4 wherein a notch is cut in both ends of the base between each of the arcuate segments.

7. In the device of claim 4, wherein said retainer portion is connected to the first portion by a flexible junction member.

8. In the device of claim 1 wherein the retainer portion is connected to the first portion by a flexible junction member.

9. In the device of claim 1, wherein the indicia receiving first portion has disposed on its upper surface a pair of opposed mirror image inverted L-shaped members which serve as message retainers.

10. A notator device for the receipt of information concerning the item or substrate, to which the notator device is attached, which device is both adapted to be mounted directly on wire and cable, and indirectly on wire and cable via cable ties;

wherein said device comprises a first indicia receiving portion comprising a planar member having an upper smooth surface and an engaging section on its lower surface; and a second retainer portion matingly engageable with the engaging section for mounting the device on a substrate and wherein the retainer portion comprises a cup-like section having a circular base and a pair of spaced mirror image opposed vertical arcuate segments upstanding from said base, each of which arcuate segments includes a detent, and said detent is pentagonally configured and disposed along the upper periphery of the segment.

11. A notator device for the receipt of information concerning the item or substrate, to which the notator device is attached, which device is both adapted to be mounted, directly on wire and cable and indirectly on wire and cable thereon via cable ties;

wherein said device comprises a first indicia receiving portion comprising a planar member having an upper smooth surface and an engaging section on its lower surface; and a second retainer portion matingly engageable with the engaging section for mounting the device on a substrate and wherein the retainer portion comprises a cup-like section having a circular base and a pair of spaced mirror image opposed vertical arcuate segments upstanding from said base, further including a pair of spaced hemispherical platforms of an elevation higher than that of said base but lower than that of the two arcuate segments, said platforms each disposed within the interior curvature of one arcuate segment.

12. A notator device for the receipt of information concerning the item or substrate, to which the notator device is attached, which device is both adapted to be mounted directly on wire and cable, and indirectly on wire and cable via cable ties;

said device comprises a first indicia receiving portion comprising a planar member having an upper surface and a lower surface, the upper surface being smooth for the receipt of information and having an engaging section on the lower surface directly beneath the surface for the receipt of information; and a second retainer portion matingly engageable with the engaging section for mounting the device on a substrate;

wherein the engaging section comprises:

(a) a circular disc of a diameter lesser than the width of the planar member (b) a circumscribing annular collar spaced outward from the circular disc disposed along the exterior edges of the width of the planar member, and spaced inwardly from the extremes along the length of the planar member; and wherein the retainer portion comprises a cup-like section having a circular base and a pair of spaced mirror image opposed vertical arcuate segments upstanding from said base.

13. In the device of claim 12 wherein the circumscribing annular collar comprises a plurality of spaced arcuate segments and each spaced arcuate element has a first rectangular cross sectioned element and a triangular shaped boss disposed upwardly from the interior edge of the rectangular element.

14. In the device of claim 12 wherein each of the two arcuate segments of the retainer portion includes a detent.

15. In the device of claim 12 wherein said retainer portion is connected to the first portion by a flexible junction member.

* * * * *